United States Patent [19]

Katayama

[11] Patent Number: 4,584,129

[45] Date of Patent: Apr. 22, 1986

[54] ELECTRIC INSULATING OILS

[75] Inventor: Takao Katayama, Ichihara, Japan

[73] Assignee: Idemitsu Kosan Company Limited, Tokyo, Japan

[21] Appl. No.: 743,585

[22] Filed: Jun. 11, 1985

[30] Foreign Application Priority Data

Jun. 18, 1984 [JP] Japan ..... 59-123836

[51] Int. Cl.[4] ..... H01B 3/22

[52] U.S. Cl. ..... 252/570; 208/14; 208/143; 585/6.6

[58] Field of Search ..... 208/14, 59, 143; 585/6.6; 252/570

[56] References Cited

U.S. PATENT DOCUMENTS

| | | | |
|---|---|---|---|
| 3,732,154 | 5/1973 | Mills et al. | 208/14 |
| 3,849,288 | 11/1974 | Milstein et al. | 208/14 |
| 4,069,165 | 1/1978 | Masunaga et al. | 208/14 |
| 4,070,297 | 1/1978 | Masunaga et al. | 208/14 |
| 4,196,408 | 4/1980 | Link | 208/14 |
| 4,324,933 | 4/1982 | Kimura et al. | 208/14 |
| 4,442,027 | 4/1984 | Sato et al. | 252/570 |
| 4,542,246 | 9/1985 | Matsunaga et al. | 585/6.6 |

*Primary Examiner*—Andrew H. Metz
*Assistant Examiner*—Anthony McFarlane
*Attorney, Agent, or Firm*—Frishauf, Holtz, Goodman & Woodward

[57] ABSTRACT

This invention relates to electric insulating oils consisting of mineral oils having boiling point of 200° C. or higher, preferably from 250° to 450° C., and having a viscosity of from 2 to 500 cst (at 40° C.), pour point of −35° C. or below, a sulfur content of 5 ppm or less and an aromatic hydrocarbon content (% $C_A$) of 5% or less.

5 Claims, 1 Drawing Figure

ELECTRIC INSULATING OILS

FIELD OF THE INVENTION

This invention relates to electric insulating oils and more particularly to electric insulating oils having high thermal stability.

BACKGROUND OF THE INVENTION

In recent years, transformers with super high voltages (higher than 1 million volts) which are of large size are being developed in accordance with an increased demand for electric power.

Accordingly, in order to obtain an improvement of insulating reliability, the required properties for electric insulating oils are becoming more severe. Particularly, in insulating oils for super high voltage transformers, an increment of dielectric loss tangent (tan δ) accompanied by deterioration of thermal stability is becoming a serious problem. The heat generated in a dielectric is increased on account of the increased tan δ, which results in heating generation of the transformers.

Regarding the increased tan δ, various causes are considered, and yet, sufficient elucidation has not been brought about. There is a report that presence of copper exerts an influence. Under the circumferences, an effort has been made to suppress the increment of tan δ by adding a small amount of 1,2,3-benzotriazole (BTA), which reacts quantitatively with copper, to ordinary mineral base oil. But, it is difficult to prevent the increment of tan δ completely, and moreover, an introduction of an improved technique has been hoped for.

SUMMARY OF THE INVENTION

An object of this invention is to provide electric insulating oils which eliminate the above problems and exhibit a minimum change of tan δ over a period of time.

The novel features which are considered as characteristic for the present invention are set forth in particular in the appended claims.

DETAILED DESCRIPTION OF THE INVENTION

Figure 1:
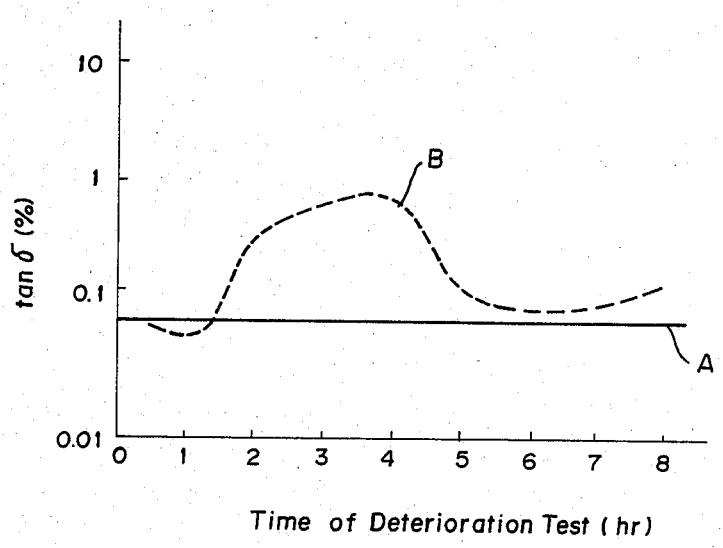
FIG. 1 is a graph showing a change over a period of time of tan δ of the electric insulating oil. Curve A shows oils of the present invention, and curve B shows conventional oils.

This invention relates to electric insulating oils consisting of mineral oil having boiling point of 200° C. or higher, preferably from 250° to 450° C., and having viscosity of from 2 to 500 cst (at 40° C.), preferably from 3 to 40 cst (at 40° C.), pour point of −35° C. or below, sulfur content of 5 ppm or less and aromatic hydrocarbon content (% $C_A$) of 5% or less.

The electric insulating oil of this invention can be obtained by treating a distillated oil having boiling point of from 250° to 450° C. (in atmospheric pressure conversion). This distillated oil can be obtained by distillating mineral oils, particularly paraffinic crude oils by the following four processes. The distilled oil is obtained by distillating the crude oil at atmospheric pressure or atmospheric residual oil under reduced pressure.

(1) the distilled oil is subjected to a hydrogenation treatment, and then, an alkali distillation or sulfuric acid cleaning is carried out, (2) the distilled oil is subjected to the hydrogenation treatment and then, it is subjected to a second stage hydrogenation treatment, (3) the distilled oil is subjected to a hydrogenation treatment, and is subjected to a second stage hydrogenation treatment and furthermore, is subjected to a third stage hydrogenation, and (4) the distillated oil is subjected to a hydrogenation treatment, and is subjected to a second stage hydrogenation treatment, and is subjected to an alkali distillation or sulfuric acid cleaning. An example of the treating method follows.

A crude lubricating oil is prepared from an intermediate base oil such as Kuwait crude oil and the like by a conventional method, and it is subjected to a severe hydrogenation treatment. Ingredients not favorable to the luboil fraction such as aromatic ingredient, etc. are eliminated or converted into effective ingredients by this treatment. At this time, most of the sulfur and nitrogen components are also eliminated.

And then, fractional distillation is carried out to obtain oils having the required viscosity by distillation under reduced pressure. Thereafter, a known solvent dewaxing is carried out to provide oils having a pour point of ordinary paraffin base oil, namely, from about −15 to −10° C.

After the dewaxing treatment, a further hydrogenation treatment is carried out to hydrogenate a major portion of the aromatic ingredient to produce a saturated ingredient, and thus, thermal and chemical stability of the base oil is improved. However, since its pour point is still high, the resulting oil is not appropriate as the electric insulating oil. For this reason a severe dewaxing treatment is then carried out. As this treatment, a solvent dewaxing method under severe conditions or a catalytic hydrogenation dewaxing method is applied in which a zeolite catalyst is used, and paraffin (primarily, normal paraffin) which is adsorbed to the pores of the catalyst is selectively decomposed in a hydrogen atmosphere and the material that forms to the wax ingredient is eliminated.

The hydrogenation treatment is carried out under conditions where the reaction temperature is from 200° to 500° C., and the hydrogen pressure is from 5 to 200 kg/cm$^2$ and the feed amount of hydrogen (per 1 kiloliter of supplied distillated oil) is from 100 to 3000 Nm$^3$, preferably from 300 to 2000 Nm$^3$. The catalyst which is used in this treatment can be prepared by using alumina, silica, silica-alumina, zeolite, active charcoal, bauxite and the like as a carrier, and metals of the Periodic Table Group VI and Group VIII, preferably catalytic ingredients such as cobalt, nickel, molybdenum, tungsten and the like are deposited on the carrier by conventional methods. The catalyst is preferably presulfurized.

As described in the foregoing, the distilled distillated oil is subjected to various treatments after the hydrogenation treatment. When the second stage or the third stage hydrogenation treatment is carried out, the conditions of the hydrogenation may be selected within the ranges described above, and each condition of the first through the third stage may be set to the same or different conditions.

Next, the alkali distillation is carried out to improve the stability of the distilled ingredient by eliminating a small amount of the acidic material, and it is carried out by distillation under reduced pressure by adding an alkaline substance such as NaOH, KOH and the like.

Also, the sulfuric acid cleaning is carried out generally as a finishing step for the petroleum product, and it is applied for improving the properties of the distilled oil by eliminating the aromatic hydrocarbons, particularly, the polycyclic aromatic hydrocarbons or olefins, and sulfur compounds. In this invention, from 0.5 to 5% by weight of concentrated sulfuric acid is added to the treated oil and the treatment is carried out at a temperature of from room temperature to 60° C., and thereafter, neutralization is carried out with NaOH and the like.

The treatment of the distillated oil according to the method of this invention is carried out by any one of the above described methods (1) to (4), but among these methods, particularly, the method (3) is preferable.

The distilled oil obtained by the foregoing treatment has excellent properties as an electric insulating oil such as viscosity is from 3 to 40 cst (at 40° C.), and pour point is −35° C. or below, and sulfur content is 5 ppm or less and aromatic hydrocarbon content (% $C_A$) is 5% or less. The change over period of time of tan δ of the oil of this invention is small, and the thermal stability of said oil is extremely excellent, and thus the use of additives which heretofore were required is no longer needed. However, in order to improve the gas absorption property, 0.5 to 20% of α-, β-methylnaphthalene, and 0.5 to 50% of alkyl benzene may be added.

As described in the foregoing, the electric insulating oil of this invention has satisfactory thermal stability so that it can be effectively utilized as the insulating oil for use in super high voltage transformers.

With respect to the oil sample shown in the following Table 1, the change of tan δ over a period of time was measured. The measurement was carried out under the following conditions: amount: 500 milliliters, temperature: 95° C., amount of copper: 44.8 $cm^2$/100 milliliters, amount of air feed: 1 liter/hr, and time: 8 hours. The results are shown in FIG. 1.

TABLE 1

| Property | Sample oil | | |
|---|---|---|---|
| | Product 1 of this invention | Conventional product | Product 2 of this invention |
| Specific gravity (15/4° C.) | 0.857 | 0.853 | 0.857 |
| Viscosity (cst, 40° C.) | 9.2 | 7.8 | 9.2 |
| Viscosity (cst, 100° C.) | 2.4 | 3.2 | 2.4 |
| Pour point (°C.) | −50 | −32 | −42.5 |
| Sulfur content (ppm) | ≦1 | 0.28 wt % | ≦1 |
| Bromine number (g/100 g) | 2.7 | 21.3 | 3.2 |
| Ring analysis | | | |
| % $C_A$ | 0.8 | 8.3 | 0.8 |
| % $C_N$ | 46.0 | 43.0 | 42.8 |
| % $C_P$ | 53.2 | 48.7 | 56.4 |
| Fluidity charging characteristic half reduction period (sec.) | 2000 | 1000 | 2000 |
| Corrosive sulfur (140° C., 19 hr.) | non-corrosive | non-corrosive | non-corrosive |

As will be obvious from the drawing, the tan δ of the product of this invention has extremely small change over a period of time, and excellent thermal stability.

While the invention has been illustrated and described as embodied in insulating oils, it is not intended to be limited to the example shown, since various changes may be made without departing in any way from the spirit of the present invention.

What is claimed is:

1. An electric insulating oil consisting essentially of a mineral oil having a boiling point of 200° C. or higher, a viscosity of from 2 to 500 cst (at 40° C.), a pour point of −35° C. or below, a sulfur content of 5 ppm or less and an aromatic hydrocarbon content (% $C_A$) of 5% or less.

2. The electric insulating oil of claim 1, wherein said mineral oil has a boiling point of from 250° to 450° C.

3. The electric insulating oil of claim 1, wherein said oil has a viscosity of from 3 to 40 cst (at 40° C.).

4. The electric insulating oil of claim 1, wherein said oil is prepared by subjecting a distilled oil to three sequential hydrogenation treatments.

5. The electric insulating oil of claim 2, wherein said oil has a viscosity of from 3 to 40 cst (at 40° C.).

* * * * *